United States Patent [19]

Roberts

[11] 4,087,141

[45] May 2, 1978

[54] DOOR PULL HANDLE ASSEMBLY

[75] Inventor: Edward H. Roberts, Jeffersontown, Ky.

[73] Assignee: General Electric Company, Louisville, Ky.

[21] Appl. No.: 720,130

[22] Filed: Sep. 3, 1976

[51] Int. Cl.[2] ..... A47B 95/02

[52] U.S. Cl. ..... 312/320; 16/110 R; 16/125

[58] Field of Search ..... 312/320; 16/111 R, 110 R, 16/125

[56] References Cited

U.S. PATENT DOCUMENTS

| | | | |
|---|---|---|---|
| 2,066,301 | 12/1936 | Plack | 16/111 R |
| 2,151,195 | 3/1939 | DeVoe et al. | 16/111 R |
| 2,314,522 | 3/1943 | Sette | 16/125 |
| 2,402,407 | 6/1946 | Jakeway | 16/110 R |
| 2,407,763 | 9/1946 | North et al. | 16/125 |
| 2,608,712 | 9/1952 | Seyforth | 16/125 |
| 3,151,350 | 10/1964 | Manion | 16/110 R |
| 3,692,155 | 9/1972 | Laurita | 16/110 R |
| 3,766,598 | 10/1973 | Roberts | 16/125 |
| 3,995,349 | 12/1976 | Roberts et al. | 16/125 |

FOREIGN PATENT DOCUMENTS

| | | | |
|---|---|---|---|
| 242,315 | 1/1965 | Austria | 16/110 R |

*Primary Examiner*—Paul R. Gilliam
*Assistant Examiner*—Victor N. Sakran
*Attorney, Agent, or Firm*—Francis H. Boos

[57] ABSTRACT

A front-mounted door pull handle assembly is shown on a refrigerator door. The handle is formed of a long extruded metal bar having a mounting bracket fastened on each end. A fastening screw extends through the end of the bar and through the mounting bracket and into a supporting surface. A flexible, decorative cover member snaps over the outside of the bar. The cover has longitudinal ribs to rigidify the cover and hold it on the bar. The bar, in turn, has longitudinal grooves for receiving the ribs.

7 Claims, 4 Drawing Figures

DOOR PULL HANDLE ASSEMBLY

BACKGROUND OF THE INVENTION (1) Field Of The Invention

This invention relates to a door pull handle assembly, and particularly to a front-mounted handle having all fastening means hidden from sight.

(2) Description Of The Prior Art

The present invention relates to front-mounted door pull handle assemblies in general, but particularly to door handles such as for use with large appliances as refrigerators or combination two-door, top-mount refrigerators as are quite common on the market today. Such refrigerator door handles are usually rather long and are mounted vertically to afford ready access to small children as well as adults. In a two-door refrigerator, each door would have to have its own door handle. Refrigerator doors are opened so frequently the door handles must be rugged in construction as well as being pleasing in appearance. Chromium-plated die castings would be acceptable except that their cost is rather exorbitant at today's prices.

Composite door handle assemblies have been devised wherein certain non-critical parts utilize low-cost material such as molded plastic that is chromium or aluminum plated to have the appearance of a chromium die casting. One example of such a handle is shown in U.S. Pat. No. 3,766,598 of the present inventor which is also assigned to the present assignee. This patent shows an elongated, U-shaped, molded plastic hand-grip portion which is capable of being mounted on the door with two front-mounted screw fasteners. A steel reinforcing insert is added to the hand-grip portion but first it is covered by a sheet of decorative trim of wood grain vinyl. A third screw is threaded up into the bottom of the hand-grip portion to hold the steel insert in place, but this third screw is out of view.

Another example of a front-mounted refrigerator door handle assembly is shown in the published Patent Application B 589,687, dated Mar. 23, 1976, of the present inventor Edward H. Roberts and Gordon V. Carter, which is also assigned to the present assignee. This is a particularly beautiful door handle that is shaped very much like an archer's bow. It comprises a plurality of parts, where the main handgrip portion is a chromium or aluminum-plated molded plastic part, and a metal reinforcing member is fitted into the plastic part. A cover member of thin sheet metal which is finished with a sheet of wood grain material to serve as a decorative finish.

An early patent on a front-mounted drawer pull handle is U.S. Pat. No. 2,608,712 of R. C. Seyforth. This patent discloses a metal base plate that is screwed to the supporting surface, and there is a cover member that is snapped over the base to conceal the mounting screw.

The principal object of the present invention is to provide a front-mounted door pull handle assembly with an elongated hand-grip portion that is covered with a flexible, decorative cover which snaps in place and is reinforced so that it has the feel of a solid member.

A further object of the present invention is to provide a handle assembly of the class described where the hand-grip portion is provided with separable mounting brackets at each end and the cover member hides the fastening means for the mounting brackets from sight.

A further object of the present invention is to provide a handle assembly of the class described where the hand-grip portion is an extruded member of uniform transverse cross-section which may easily be made of any length.

A still further object of the present invention is to provide a handle assembly of the class described with a snap-on cover member that has holding ribs and stabilizing ribs so that the cover has the feel of a solid member.

SUMMARY OF THE INVENTION

The present invention, in accordance with one form thereof, relates to a front-mounted door pull handle assembly having an elongated bar with a mounting bracket located adjacent each end. Each bracket is adapted to receive a front-mounted fastening means therethrough. The bar has a front face with a longitudinal groove formed therein. At each side of the bar is formed a longitudinal groove. A flexible cover member is adapted to slip over the bar. The cover has longitudinal holding ribs for snapping into the grooves at each side of the bar. The cover member also has a rib for engagement with the longitudinal groove on the front face of the bar to stabilize the cover member and rigidify it so that it has the feel of a solid member.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
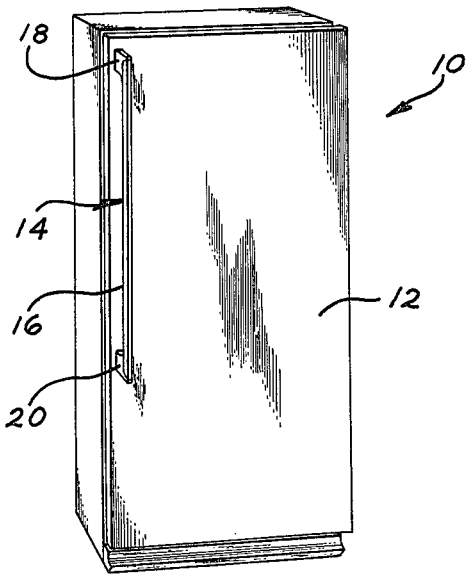
FIG. 1 is a front perspective view of a single-door household refrigerator having a door pull handle assembly embodying the present invention.

Turning now to a consideration of the drawings, and in particular to FIG. 1, there is shown a household refrigerator cabinet 10 having a right-hand swinging front door 12 with an elongated, vertically-mounted, door handle assembly 14 comprising the present invention. Notice that the door handle 14 comprises three main elements; namely, an elongated bar 16 and a mounting bracket 18 and 20 at each end of the bar.

Figure 2:
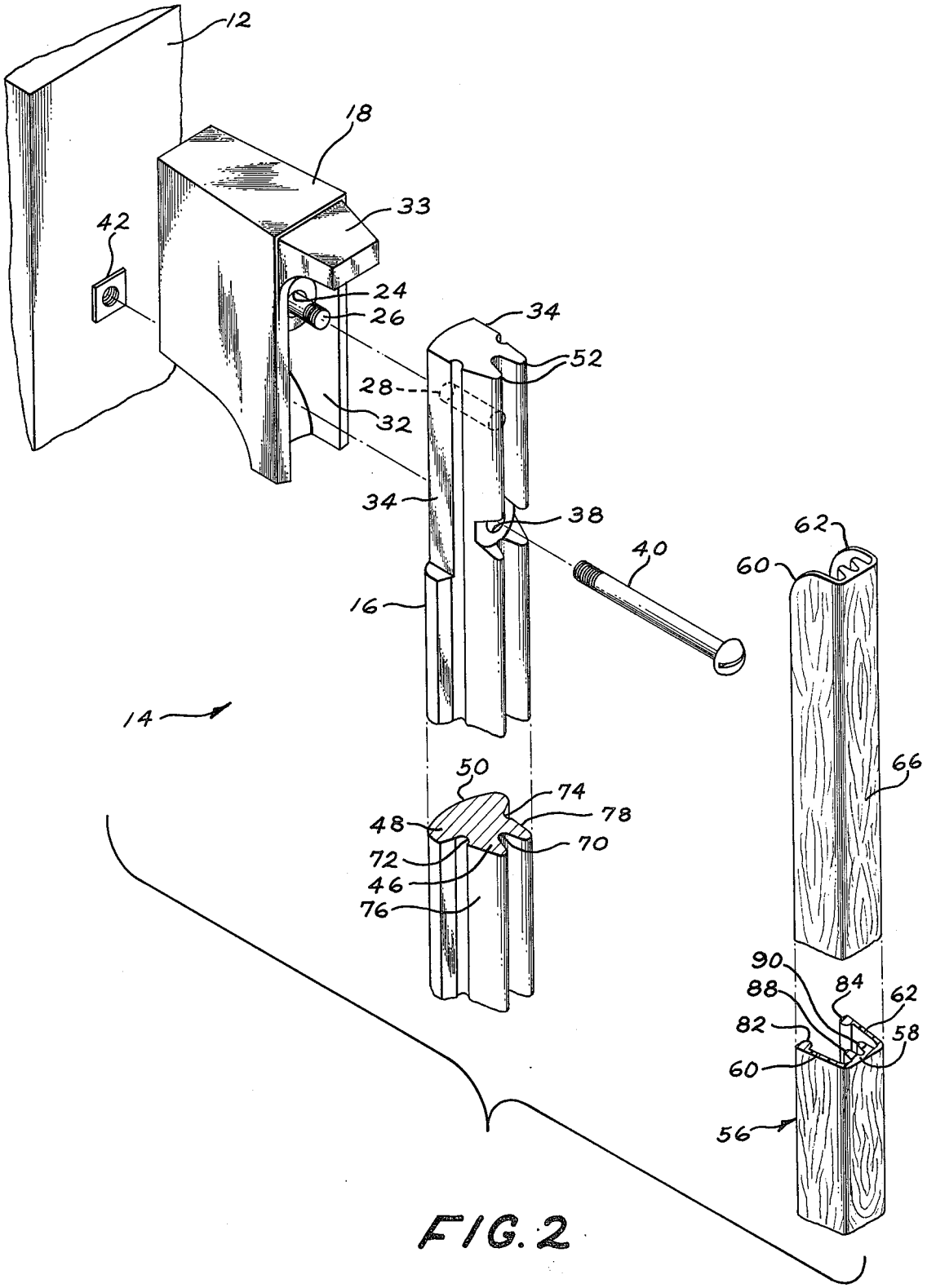
FIG. 2 is a fragmentary exploded view on an enlarged scale of the top end of the door handle assembly of FIG. 1.

The door handle assembly 14 can best be understood with reference to the fragmentary exploded view of FIG. 2. The elongated bar 16 is an extruded aluminum bar which may be cut to any length, and it is fitted with the identical mounting brackets 18 and 20 which happen to be molded plastic parts that have their outer surface metal-plated or metallized, as for example electroplated chromium. The mounting bracket 18 is a separable, post-like member that is provided with an aperture 24 for receiving a rear-mounted screw 26 therethrough which is in turn threaded into a tapped opening 28 in the rear face of the bar 16. The mounting bracket 18 is provided with a channel-shaped cut-out 32 for receiving the rear half of the end of the bar 16 therein. A flat side 34 is machined in each side of the end of the bar 16 for a close-fitting relationship with the sides of the channel formation 32. The bracket 18 also has an integral hollow end cap formation 33 for receiving the end of the bar therein. Near the threaded aperture 28 in the end of the bar 16 is a second through-aperture 38 for receiving the front-mounting screw 40. This screw is adapted to fit through a through-opening (not shown ) in the mounting bracket 18 and is to be threaded into a retaining nut 42 that is fixed in the front wall of the door 12. Thus, in order to fasten the mounting bracket 18 to the bar 16 and then the bar to the door 12, it is first necessary to slip the bracket 18 on the end of the bar, and then fasten them together by means of the rear-mounting screw 26. Then, the front-mounting screw 40 is positioned through the opening 38 in the bar, and through a mating opening (not shown) in the mounting bracket 18 to be threaded into the retaining nut 42. This is a very simple operation both in the assembly and in the removal, and it may be accomplished from the front of the door without entering into the interior of the door structure.

Figure 3:
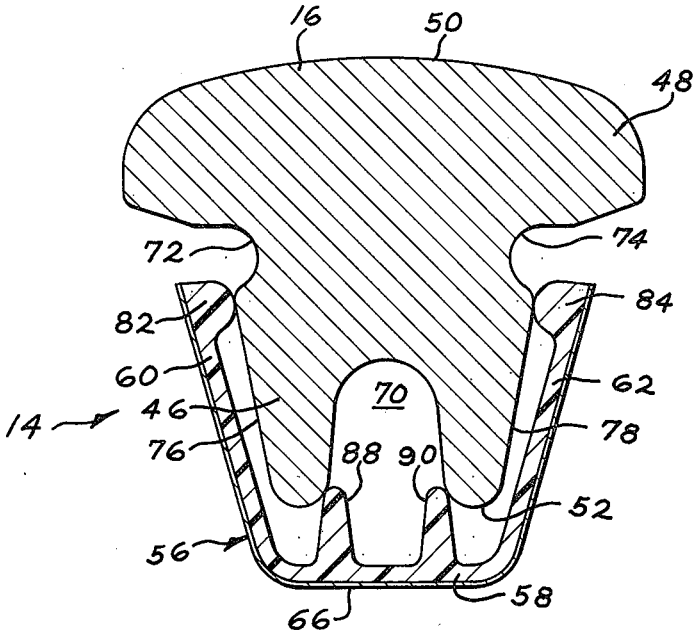
FIG. 3 is a transverse cross-sectional view on an enlarged scale through the extruded bar with the flexible cover member removed from the bar but positioned adjacent the bar to show the relative dimensions of the cover member with respect to the bar.

The nature of the transverse cross-section of the extruded bar 16 can be best understood from the enlarged view of FIG. 3. This transverse cross-sectional configuration may be likened to that of an oversized mushroom or rail with a thick shank portion 46 and an enlarged head portion 48. Actually, this bar 16 is usually arranged in a vertical position so that the top surface 50 of the head 48 is really a hand-grip surface for receiving a person's fingers for pulling back against the bar for opening the door. The bottom surface 52 of the shank 46 is actually the front face of the bar 16 and it would be used as a hand-grip surface for pushing against the bar for exerting a closing action on the door.

Figure 4:
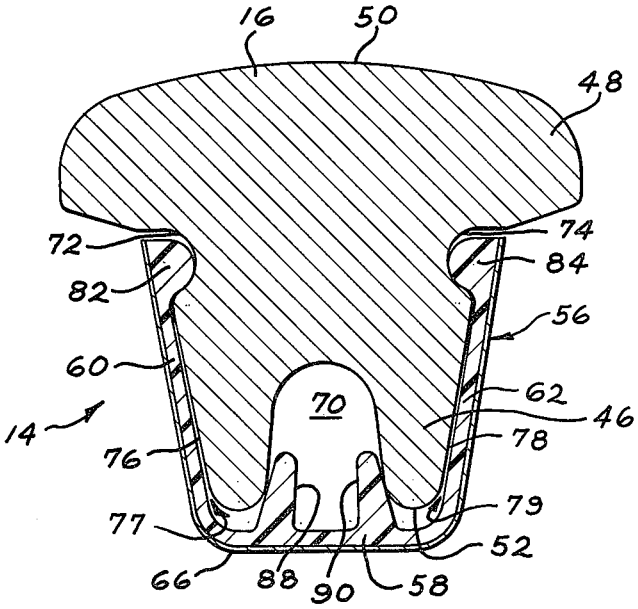
FIG. 4 is a transverse cross-sectional view similar to that of FIG. 3 after the cover member has been pushed onto the bar and snapped into place to serve as a rigid decorative member.

It is preferable to provide some means for hiding the front-mounting screws 40 from sight because, otherwise, the screws become dust catchers that are hard to clean. An elongated, flexible snap-on cover member 56 is provided for fastening over the shank 46 of the bar 16 from one end to the other. This cover member 56 is an extruded channel-like, plastic member of generally U-shape configuration in transverse cross-section having a bight portion 58 and a pair of slide flanges or leg portions 60 and 62. Bonded to the outer surface of this cover member 56 is a thin sheet of wood grain vinyl 66 which gives the cover member the appearance of a finely-finished piece of select wood that has been fashioned by a skilled wood craftsman. The front face 52 of the bar 16 is provided with a longitudinal groove 70 that is rather wide and deep, and extends the complete length of the bar. Moreover, the sides of the shank 46 are each provided with a smaller longitudinal groove 72 and 74 that are positioned just beneath the underside of the head 48. Notice that the opposite sides 76 and 78 of the shank 46 are convergent toward the front face 52 of the bar. Moreover, the two leg portions 60 and 62 of the cover member 56 are divergent as they extend away from the bight porion 58. Due to the necessity for allowing manufacturing tolerances for both the extruded aluminum bar 16 and the extruded vinyl cover member 56, it is necessary to make the cover member slightly oversized so that there would always be a clearance 77 between the leg 60 and the inclined surface 76 and, similarly, clearance 79 between the leg 62 and the inclined surface 78, as is best seen in FIG. 4.

The inner surface of the edge of each leg portion 60 and 62 is provided with a longitudinal rib 82 and 84, respectively, which are adapted to snap into the grooves 72 and 74 to serve as a holding means for the cover member 56 on the shank 46 of the bar 16. Because of the clearances 77 and 79 between the flanges or leg portions 60 and 62 and the adjacent surfaces 76 and 78 of the shank, the cover member 56 is a little bit soft. This is alleviated by the introduction of bifurcated ribs 88 and 90 on the inner surface of the bight portion 58 for engagement into the groove 70. There is a slight amount of an interference fit between the ribs 88 and 90 with the throat of the groove 70, as is best seen by comparing the loose fit of the cover 56 with the shank in FIG. 3 with the assembled position of the cover in FIG. 4. These ribs 88 and 90 serve as stabilizing ribs as well as help to rigidify the cover member so that it feels as a solid member.

Modifications of this invention will occur to those skilled in this art; therefore, it is to be understood that this invention is not limited to the particular embodiments disclosed, but that is is intended to cover all modifications which are within the true spirit and scope of this invention as claimed.

What is claimed is:

1. A handle assembly comprising:

an elongated bar having a longitudinal groove formed in its front face and a longitudinal groove formed in each side;

an elongated flexible cover member for fastening over said bar, said cover member being of generally U-shaped cross section with a bight portion and opposite leg portions;

a longitudinal rib on the inner side of each cover leg portion for engagement with the longitudinal side grooves;

said cover member and bar being sized to provide a clearance between at least a portion of the space between each cover inner side and the sides of said bar; and a longitudinal rib on the inner surface of the cover bight portion for engagement with the longitudinal front groove.

2. The handle assembly of claim 1, wherein the longitudinal rib of the cover bight portion is bifurcated.

3. The handle assembly of claim 1, wherein said elongated bar has a uniform transverse cross-section of generally mushroom shape with a thick shank portion and an enlarged head portion, the bottom edge of the shank serving as the front face of the bar, and the side grooves located adjacent the underside of the head portion; and wherein said cover member substantially covers the shank portion of the bar.

4. The handle assembly of claim 1, which further comprises an enlarged mounting bracket adjacent each end of said bar, each mounting bracket having an aperture for receiving a front-mounted fastening means; and wherein said cover member extends over the mounting bracket aperture so as to conceal the fastening means.

5. The handle assembly of claim 4, wherein the mounting brackets are separable from said elongated bar, and said bar is an extruded member of generally uniform transverse cross-section, with the ends of said bar over the mounting brackets, each end of said bar including an aperture for receiving the front-mounted fastening means therethrough; and which further comprises rear mounted means for fastening each mounting bracket to said bar.

6. The handle assembly of claim 5, wherein the longitudinal rib of the cover bight portion is bifurcated.

7. The handle assembly of claim 6, wherein said elongated bar has a uniform transverse cross-section of generally mushroom shape with a thick shank portion and an enlarged head portion, the bottom edge of the shank serving as the front face of the bar, and the side grooves located adjacent the underside of the head portion., and wherein said cover member substantially covers the shank portion of the bar.

* * * * *